US007577376B2

(12) United States Patent
Kobayashi

(10) Patent No.: US 7,577,376 B2
(45) Date of Patent: Aug. 18, 2009

(54) APPARATUS WITH ADDITIONALLY INSTALLABLE EQUIPMENT

(75) Inventor: Takashi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 141 days.

(21) Appl. No.: 11/079,207

(22) Filed: Mar. 15, 2005

(65) Prior Publication Data

US 2005/0208843 A1 Sep. 22, 2005

(30) Foreign Application Priority Data

Mar. 18, 2004 (JP) ..... 2004-077655

(51) Int. Cl.
*G03G 15/00* (2006.01)

(52) U.S. Cl. ..... 399/107; 399/391; 399/393

(58) Field of Classification Search ..... 399/107, 399/110, 391, 393, 411
See application file for complete search history.

(56) References Cited

U.S. PATENT DOCUMENTS 5,666,595 A * 9/1997 Sameshima et al. ..... 399/110
2004/0052561 A1* 3/2004 Ouchi ..... 399/393
2007/0212106 A1* 9/2007 Aramata ..... 399/107

FOREIGN PATENT DOCUMENTS

JP 06-115725 4/1994
JP 08-157082 6/1996

* cited by examiner

*Primary Examiner*—David M Gray
*Assistant Examiner*—Ruth N Labombard
(74) *Attorney, Agent, or Firm*—Rabin & Berdo, P.C.

(57) ABSTRACT

An apparatus with the additionally installable equipment. The apparatus includes an apparatus housing and an additionally installable equipment detachably attached to the apparatus housing. An inserted portion is formed to a bottom surface of the apparatus housing, and an inserting portion is formed to an upper surface of the additionally installable equipment. When the additionally installable equipment is detached from the apparatus housing upon titling the apparatus housing at a tilt angle, a summation of the tilt angle and an interference angle formed of a point where the inserted portion and the inserting portion interfere with each other is rendered less than forty five degrees. Thus, when the additionally installable equipment is detached from the apparatus housing, the additionally installable equipment can be detached from the apparatus housing without deforming the inserting portion.

2 Claims, 11 Drawing Sheets

APPARATUS WITH ADDITIONALLY INSTALLABLE EQUIPMENT

BACKGROUND OF THE INVENTION

1. Field of the Invention

This invention relates to an apparatus with an additionally installable equipment.

2. Description of Related Art

With an image forming apparatus such as, e.g., a printer, a photocopier, a facsimile machine, or the like, for example, with a printer, an additionally installable tray serving as an additionally installable equipment conventionally can be installed in a detachably attachable manner to a printer housing serving as an apparatus housing, and in a case of the printer, the additionally installable tray is disposed to a lower side of the printer housing (see, e.g., Japanese Patent Application Publication Nos. H6-115,725 and H8-157,082).

FIG. 2 is a perspective view showing a conventional printer.

In FIG. 2, numeral 11 is a printer housing while numeral 13 is an additionally installable tray, in which plural positioning holes 12 serving as inserted portions for positioning are formed to extend upward as opening on a bottom surface of the printer housing, while plural positioning pins 14 serving as inserting portions for positioning are formed as projecting upward to parts on an upper surface of the additionally installable tray 13 at positions corresponding to the positioning holes 12.

The printer housing 11 is therefore positioned with respect to the additionally installable tray 13 upon inserting respectively the positioning pins 14 into the positioning holes 12.

With the conventional printer, however, when the additionally installable tray 13 is detached from the printer housing 11, the positioning pins 14 respectively need to be pulled out of the positioning holes 12, thereby rendering this operation troublesome while occasionally causing damages on fitting portions between the positioning hole 12 and the positioning pin 14.

FIG. 3 is a view showing the operation for detaching the additionally installable tray from the printer housing of the conventional printer, and FIG. 4 is a view showing a state of the fitting portion at a time that the additionally installable tray is detached from the printer housing of the conventional printer.

As shown in drawings, when detaching the additionally installable tray 13 from the printer housing 11, an operator needs to pull respectively the positioning pins 14 out of the positioning holes 12 upon lifting up the printer housing 11 as keeping the housing horizontally as possible with putting his fingers into handles 16 formed to an upper end of each side wall of the printer housing 11.

However, when the operator cannot lift up the printer housing 11 with enough force to tilt the printer housing 11 at a tilt angle $\gamma$ with respect to the additionally installable tray 13 as shown in FIG. 4, the positioning pin 14 undesirably gets caught in the positioning hole 12 at the fitting portion between the positioning hole 12 and the positioning pin 14.

That is, where a vertex side of the tilt angle $\gamma$ is set as a non-moving-up side while a side separating from the vertex is set as a moving-up side, when the printer housing 11 is tilted, the positioning hole 12 is tilted with respect to the positioning pin 14, so that a ridgeline of the most moving-up side on an inner circumferential surface of the positioning hole 12 and an upper end of a ridgeline of the most moving-up side on an outer circumferential surface of the positioning pin 14 come in contact with each other at point pa on an upper end of the positioning pin 14 while a lower end of a ridgeline of the most non-moving-up side on the inner circumferential surface of the positioning hole 12 and a ridgeline of the most non-moving-up side on the outer circumferential surface of the positioning pin 14 come in contact with each other at point pb on a lower end of the positioning hole 12. Thus, the point pa functions as a point of application of force while the point pb functions as a fulcrum, and as the result, a base of the positioning pin 14 bends with point pc on a lower end of the ridgeline of the most non-moving-up side on the outer circumferential surface of the positioning pin 14 as an application point, thereby resulting in occurrence of a phenomenon such that the positioning pin 14 is deformed by bending, i.e., a pin bending phenomenon.

Furthermore, since the positioning pin 14 is trapped in the positioning hole 12, the additionally installable tray 13 may be lifted up in accordance with lifting motion of the printer housing 11 to suddenly fall down in the middle, thereby occasionally receiving damages.

This invention is to solve the above problems and to provide an apparatus with an additionally installable equipment, in which when the additionally installable equipment is detached from the apparatus housing, the inserting portion for setting a position does not get deformed while the additionally installable equipment does not get damaged due to falling down.

SUMMARY OF THE INVENTION

To solve the above problems, an apparatus with an additionally installable equipment according to this invention has an apparatus housing and an additionally installable equipment detachably attached to the apparatus housing.

Furthermore, an inserted portion is formed to a bottom surface of the apparatus housing while an inserting portion is formed to an upper surface of the additionally installable equipment. When the additionally installable equipment is detached from the apparatus housing upon tilting the apparatus housing at a tilt angle, a summation of the tilt angle and an interference angle formed of a point where the inserted portion and the inserting portion interfere with each other is rendered less than forty-five degrees.

In this case, since the summation of the tilt angle and the interference angle formed of the point where the inserted portion and the inserting portion interfere with each other is rendered less than forty-five degrees when the additionally installable equipment is detached from the apparatus housing upon tilting the apparatus housing at the tilt angle, the additionally installable equipment can be detached from the apparatus housing without deforming the inserting portion where the additionally installable equipment is detached from the housing apparatus.

Furthermore, since the inserted portion may not be trapped by the inserting portion, the additionally installable tray is not lifted up in accordance with a lift of the printer housing 11 nor falls down in the middle, the additionally installable equipment can be prevented from getting damaged.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS OF THE INVENTION

Hereinafter, embodiments according to this invention will be described in detail in reference to drawings. It is to be noted that in this case, a case where a printer defined as one of an image forming apparatus is used as an apparatus with an additionally installable equipment will be described.

Figure 5:
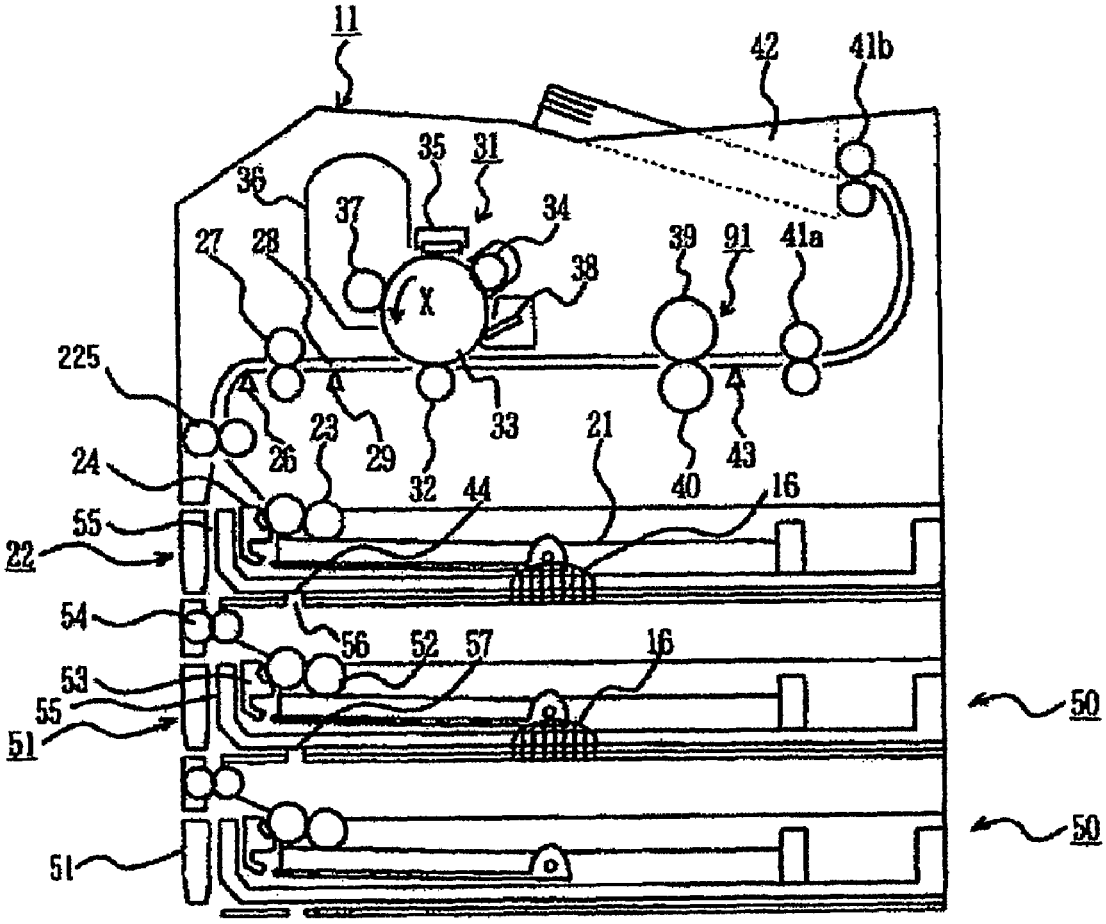
FIG. 5 is a schematic view showing a printer according to the first embodiment of this invention.

FIG. 5 is a schematic view showing a printer according to the first embodiment of this invention.

As shown in FIG. 5, a printer housing 11 serving as an apparatus housing has a medium cassette 22 serving as a medium container for containing a recording medium 21 such as, e.g., a sheet, an OHP sheet, an envelope, or the like. The recording medium 21 is conveyed with a conveyance roller 225 after picked up sheet by sheet and fed (supplied) with a feeding roller 23 and a separation frame 24, thereby reaching a absorption sensor 26 serving as a first medium detector. When the absorption sensor 26 detects a front end of the recording medium 21, a register roller 27 conveys the recording medium 21 to a conveyance route 28. Subsequently, when the recording medium 21 passes through a passing sensor 29 serving as a second medium detector disposed to the conveyance route 28, the front end of the recording medium 21 is detected with the passing sensor 29, so that an image forming section 31 starts forming a toner image serving as a developer image. The toner image is then transferred with a transfer roller 32 serving as a transfer device onto the recording medium 21 conveyed through the conveyance route 28.

Operation within the image forming section 31 for forming the toner image is described next.

A charging roller 34 serving as a charging device negatively charges a surface of a photosensitive drum 33 serving as an image carrier to be rotated in a direction of arrow X. When a negatively charged portion reaches under an exposure head 35 serving as an exposure device, the exposure head 35 exposes the photosensitive drum 33, thereby forming based on image data an electrostatic latent image onto the negatively charged portion. The electrostatic latent image is developed with a developing roller 37 serving as a developer carrier disposed inside a developing device 36, thereby turning into the toner image. The transfer roller 32 transfers the toner image onto the recording medium 21 and in this bout, the toner remaining on the surface of the photosensitive drum 33 is removed with a cleaning device 38.

Next, the toner image transferred onto the recording medium 21 is fused under high temperature and high pressure onto the recording medium 21 with a fusing device 91 composed of a heating roller 39 and a back-up roller 40. The recording medium 21 is delivered with a first delivery roller 41*a* and a second delivery roller 41*b* to a delivery stacker 42. In this situation, a delivery sensor 43 serving as a third medium detector disposed between the fusing device 91 and the first delivery roller 41*a* detects a rear end of the recording medium 21, so that the delivery of the recording medium 21 is detected.

An optional unit serving as an additionally installable equipment, i.e., an additionally installable tray 50 in this embodiment is described next.

At least one, e.g., in this embodiment, two additionally installable trays 50 are disposed in a tiered manner, and the additionally installable tray 50 right under the printer housing 11 has, likewise the printer housing 11, a medium cassette 51 serving as the medium container, in which the recording medium 21 is, likewise the medium cassette 22, picked up sheet by sheet to be fed (supplied) with a feeding roller 52 and a separating frame 53 inside the medium cassette 51, and thereafter conveyed with a conveyance roller 54. The recording medium 21 subsequently passes through a conveyance route 55 inside the medium cassette 22, reaches the conveyance roller 225, and thereafter reaches the absorption sensor 26. The recording medium 21 is afterward conveyed to the image forming section 31, and the toner image formed with the image forming section is transferred onto the recording medium 21. It is to be noted that each of the additionally installable trays 50 has the same structure.

The additionally installable tray 50 further placed under the above described additionally installable tray 50 has, likewise the above described additionally installable tray 50 right under the printer housing 11, the medium cassette 51 serving as the medium container, in which the recording medium 21 is, likewise the above described additionally installable tray 50 right under the printer housing 11, picked up sheet by sheet to be fed (supplied) with the feeding roller 52 and the separating frame 53, and thereafter conveyed with the conveyance roller 54. The recording medium 21 subsequently passes through the conveyance route 55 inside the above described additionally installable tray 50 right under the printer housing 11, passes through the conveyance route 55 inside the medium cassette 22, reaches the conveyance roller 225, and thereafter reaches the absorption sensor 26. The recording medium 21 is afterward conveyed to the image forming section 31, and the toner image formed with the image forming section is transferred onto the recording medium 21.

An installing and detaching method for the additionally installable tray 50 with respect to the printer housing 11 is described next.

Plural, or in this embodiment, two of positioning holes 44 serving the inserted portion for positioning are formed to extend upward as opening on a bottom surface 20 of the printer housing 11, while plural, or in this embodiment, two positioning pins 56 serving as the inserting portion for positioning are formed as projecting upward to parts at an upper surface 25 of the additionally installable tray 50, corresponding to the positioning holes 44. It is to be noted that the positioning hole 44 and the positioning pin 56 composes a fitting portion.

When installing the additionally installable tray 50 to the printer housing 11, an operator lifts up the printer housing 11 upon putting his fingers onto handles 16 formed to a lower end of each side wall of the printer housing 11. Subsequently, the position is set upon fitting the positioning pins 56 into the positioning holes 44, and the additionally installable tray 50 can be installed to the printer housing 11 upon putting the printer housing 11 onto the additionally installable tray 50.

It is to be noted that with the additionally installable tray 50, two positioning holes 57 serving as the inserted portion for positioning are formed to extend upward as opening on a bottom surface as well, and the handle 16 is formed to a lower end of each side wall. Thus, the plural additionally installable trays 50 are installable to the printer housing 11.

Furthermore, when detaching the additionally installable tray 50 from the printer housing 11, likewise the above, the operator lifts up the printer housing 11 upon putting his fingers into the handle 16 to pull the positioning pins 56 out of the positioning holes 44 respectively. It is to be noted that where the plural additionally installable trays 50 are installed to the printer housing 11, the predetermined additionally installable tray 50 can be detached from the printer housing 11 in the same way as the above.

A positioning mechanical section for positioning each of the additionally installable trays 50 with respect to the printer housing 11 is described next.

Figure 6:
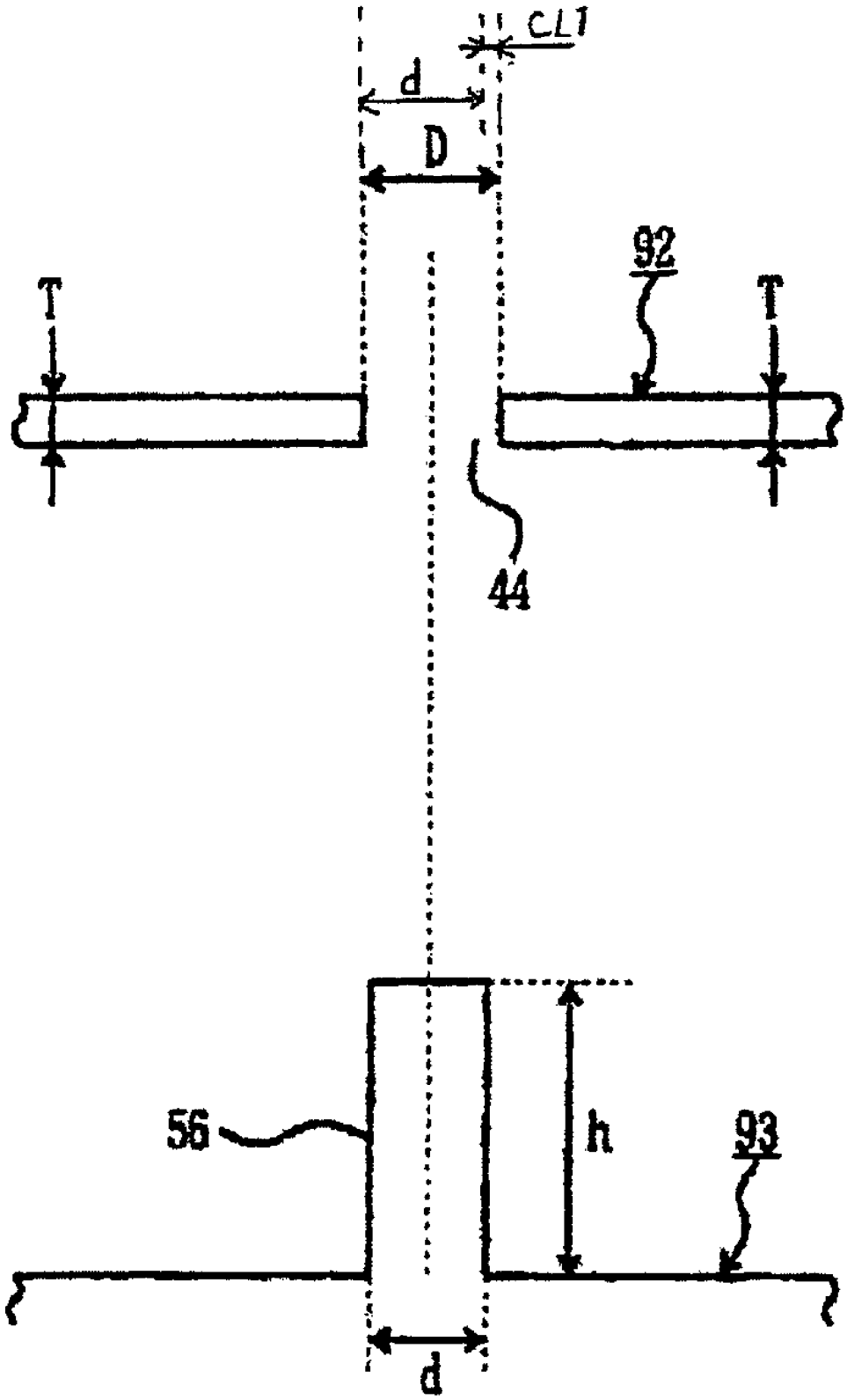
FIG. 6 is a cross-sectional view showing a positional relation between the positioning hole and the positioning pin according to the first embodiment of this invention.
Figure 7:
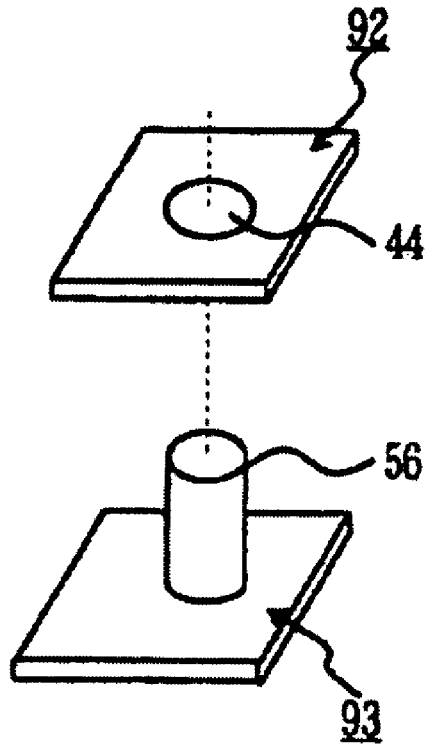
FIG. 7 is a perspective view showing the positional relation between the positioning hole and the positioning pin according to the first embodiment of this invention.

FIG. 6 is a cross-sectional view showing a positional relation between the positioning hole and the positioning pin according to the first embodiment of this invention; FIG. 7 is a perspective view showing the positional relation between the positioning hole and the positioning pin according to the first embodiment of this invention; and FIG. 8 is a view showing a state where the positioning pin is inserted into the positioning hole according to the first embodiment of this invention.

Figure 8:
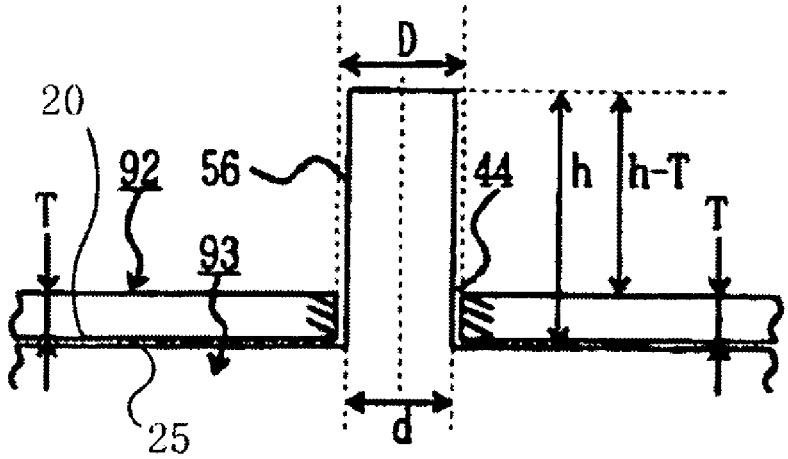
FIG. 8 is a view showing a state where the positioning pin is inserted into the positioning hole according to the first embodiment of this invention.

The positioning hole 44 is first described. A bottom wall 92 serving as a first member, configuring the bottom surface of the printer housing 11 (FIG. 5) has thickness T, in which the positioning hole 44 having a cross-sectional surface in a circular shape and inner diameter D is formed to the bottom wall 92. The positioning pin 56 having outer diameter d and height h is formed to an upper wall 93 serving as a second member, configuring the upper surface of the additionally installable tray 50.

Where the positioning pin 56 is inserted into the positioning hole 44, the positioning pin 56 is positioned with a portion of the thickness T of the positioning hole 44, and fastened to the bottom wall 92, thereby projecting upward from the bottom wall 92. A projecting portion corresponding to distance h−T becomes a free state with respect to the positioning hole 44, thereby not fastened to the bottom wall 92.

Where the operator installs the additionally installable tray 50 to the printer housing 11, as shown in FIG. 8, the upper surface 25 comes in contact with the bottom surface 20, and the positioning pin 56 is positioned with the portion of the thickness T of the positioning hole 44, thereby fastened to the bottom wall 92. In this situation, the positioning pin 56 needs to be inserted precisely into the positioning hole 44, so that clearance CL1 of the inner diameter D of the positioning hole 44 with respect to the outer diameter d of the positioning pin 56, which is determined by formula, CL1=D−d, is set to not less than 0.1 [mm] nor more than 0.2 [mm].

A positional relation between the positioning hole 44 and the positioning pin 56 at a time that the additionally installable tray 50 is detached is next described.

Figure 1:
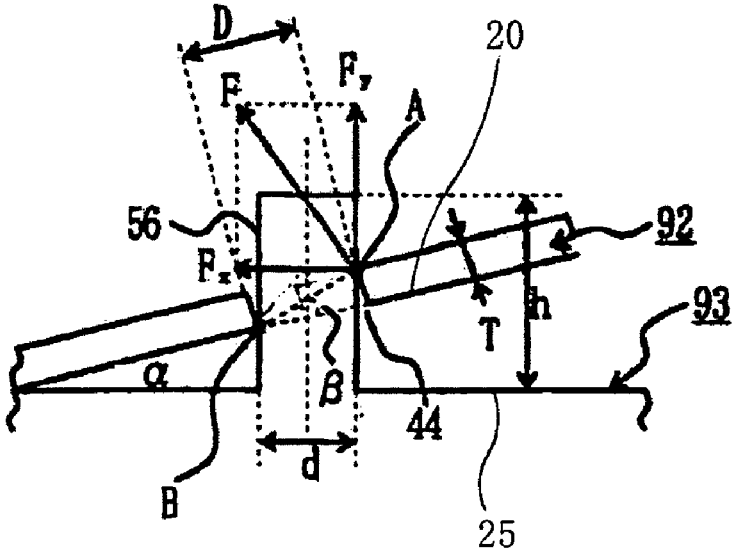
FIG. 1 is a view showing a positional relation between a positioning hole and a positioning pin at a time that an additionally installable tray is detached according to the first embodiment of this invention.
Figure 2:
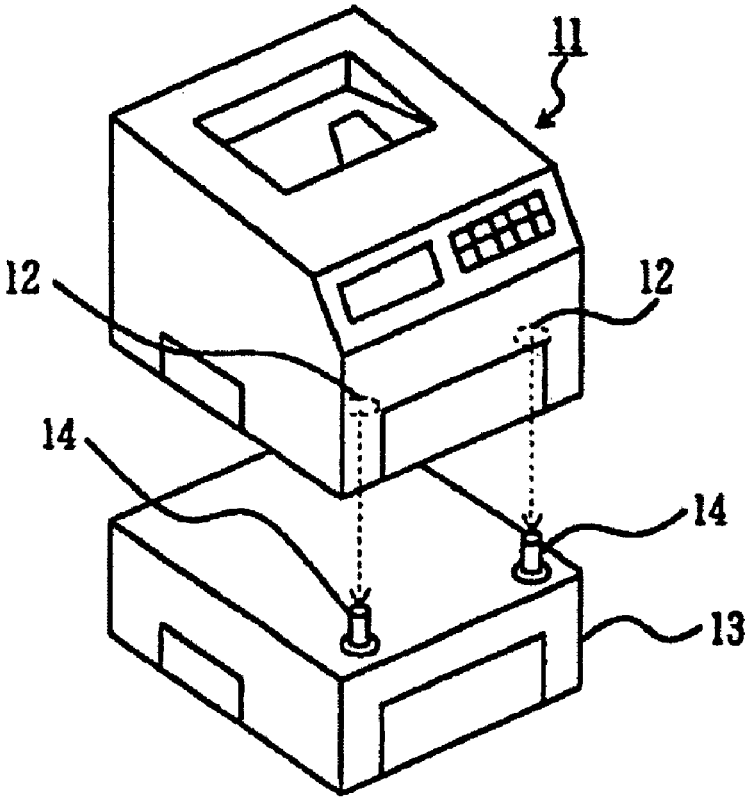
FIG. 2 PRIOR ART
FIG. 2 is a perspective view of a conventional printer.
Figure 3:
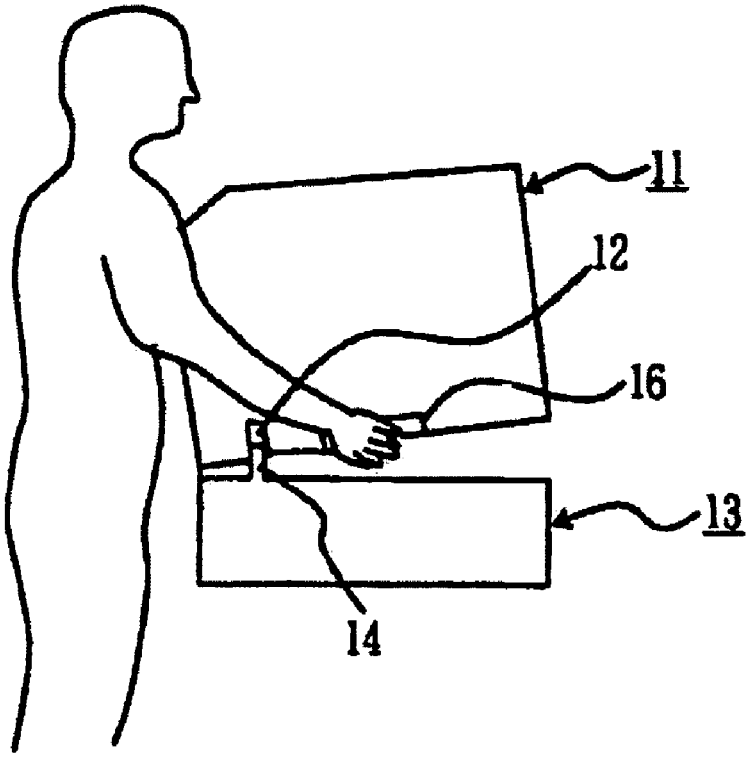
FIG. 3 PRIOR ART
FIG. 3 is a view showing an operation for detaching an additionally installable tray from a printer housing of the conventional printer.

FIG. 1 is a view showing the positional relation between the positioning hole and the positioning pin at the time of detachment of the additionally installable tray according to the first embodiment of this invention.

When the additionally installable tray 50 is to be detached from the printer housing 11 in a state where the printer housing 11 (FIG. 5) is tilted with respect to the additionally installable tray 50, the projecting portion of the positioning pin 56 is in a free state with respect to the positioning hole 44 as shown in FIG. 1, so that when the printer housing 11 is lifted up at tilt angle $\alpha$ between the bottom surface 20 and the upper surface 25, the positioning hole 44 and the positioning pin 56 interfere with each other within the fitting portion between the positioning hole 44 and the positioning pin 56.

That is, where a vertex side of the tilt angle $\alpha$ is set as a non-moving-up side while a side separating from the vertex is set as a moving-up side, when the printer housing 11 is tilted, the positioning hole 44 is tilted with respect to the positioning pin 44, so that an upper end of a ridgeline of the most moving-up side on an inner circumferential surface of the positioning hole 44 and a ridgeline of the most moving-up side on an outer circumferential surface of the positioning pin 56 come in contact with each other at point A, while a lower side of a ridgeline of the most non-moving-up side on the inner circumferential surface of the positioning hole 44 and a ridgeline of the most non-moving-up side on the outer circumferential surface of the portioning pin 56 come in contact with each other at point B.

Figure 4:
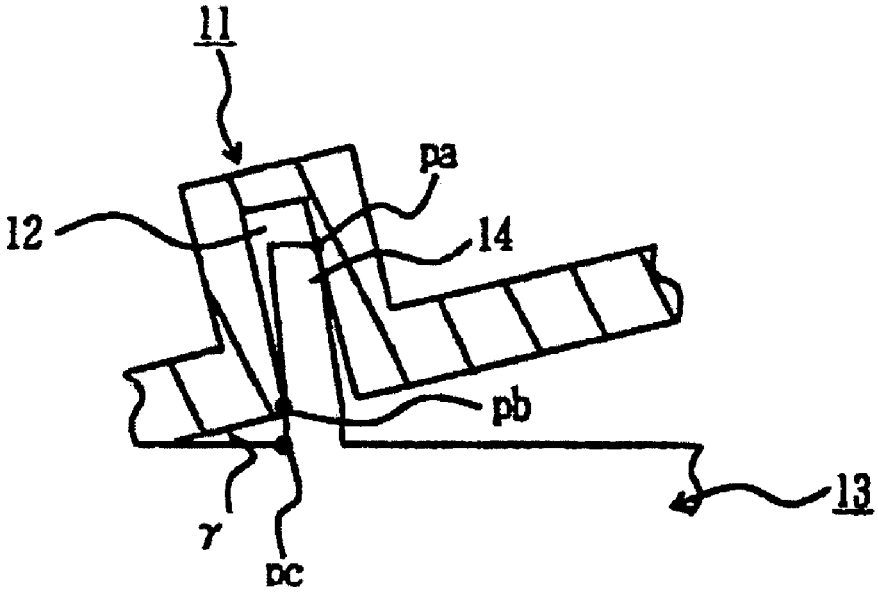
FIG. 4 PRIOR ART
FIG. 4 is a view showing a state of the fitting portion at a time that the additionally installable tray is detached from the printer housing of the conventional printer.

With conventional arts, a length of positioning pin 14 has effects on positions of points pa, pb (see FIG. 4), but in this embodiment, the thickness T, not the length h of the positioning pin 56 has effects on the positions of the points A, B since the positions of the points A, B are kept in the free state with respect to the positioning hole 44. In this bout, an angle formed of line segment AB connecting A and B, and the bottom wall 92, i.e., an interference angle is set as $\beta$.

In the meanwhile, force F occurred upon interference between the positioning hole 44 and the positioning pin 56 at the points A, B is in a direction perpendicular to the line segment AB. The force F is defined as resultant force of force Fx for bending the positioning pin 56 and force Fy for pulling the positioning pin 56 out of the positioning hole 44, and determined by formula, F=Fx+Fy. In this case, when the summation of the tilt angle $\alpha$ and the interference angle $\beta$ is set as summed angle $\theta$, in a case of the summed angle $\theta$ of not less than forty-five degrees, the force Fx becomes not less than the force Fy, so that the positioning pin is not pulled out of the positioning hole 44 but bent with the force Fx. On the other hand, where the summed angle $\theta$ is less than forty-five degrees, the force Fy becomes larger than the force Fx, so that the positioning pin 56 is not bent but pulled out of the positioning hole 44 with the force Fy.

Therefore, upon rendering the summed angle θ smaller than forty-five degrees when the additionally installable tray 50 is detached from the printer housing 11, the additionally installable tray can be detached from the printer housing 11 without deforming the positioning pin 56.

Furthermore, since the positioning hole 44 does not get caught by the positioning pin 56, it does not happen that the additionally installable tray 50 is lifted up in accordance with a lift of the printer housing 11 and falls down in the middle, so that the additionally installable tray 50 does not get damaged.

The second embodiment is next described. It is to be noted that that members structured the same as in the first embodiment are assigned with the same numerals to omit the duplicated explanation, and the advantages of this invention are applicable to the second embodiment because of the same structure as the first embodiment.

Figure 9:
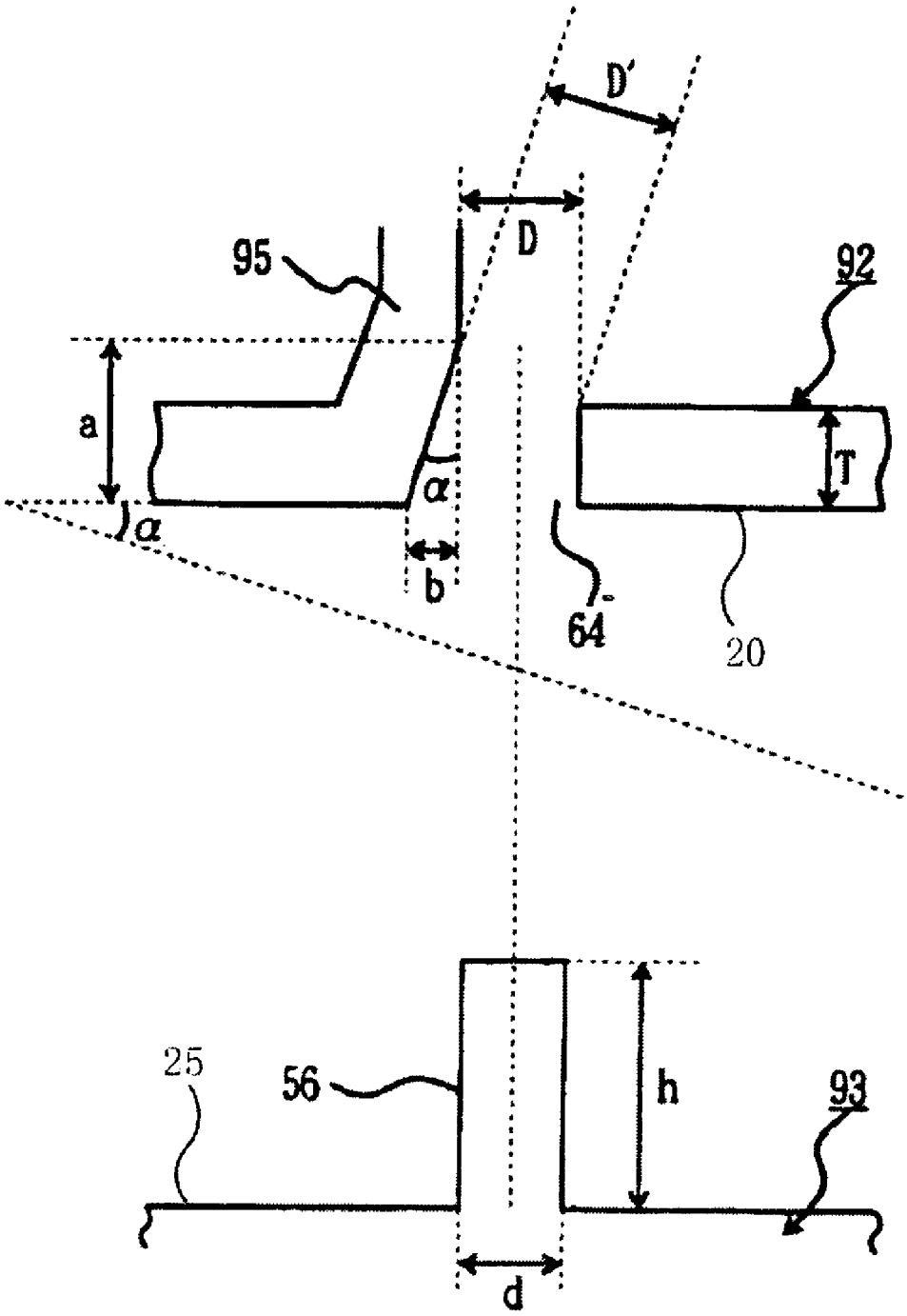
FIG. 9 is a cross-sectional view showing a positional relation between a positioning hole and a positioning pin according to the second embodiment of this invention.
Figure 10:
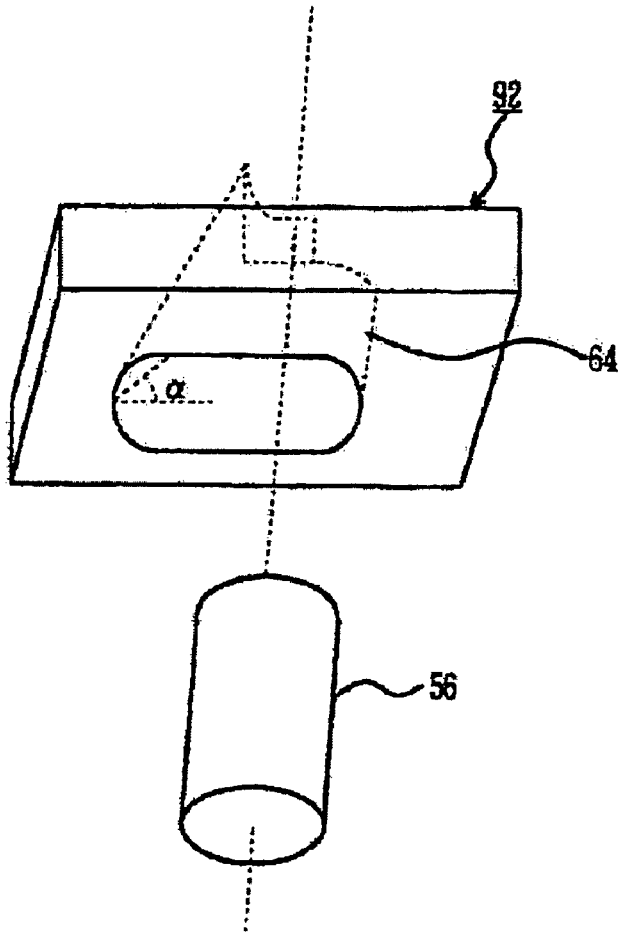
FIG. 10 is a perspective view showing the positional relation between the positioning hole and the positioning pin according to the second embodiment of this invention.

FIG. 9 is a cross-sectional view showing a positional relation between a positioning hole and a positioning pin according to the second embodiment of this invention; FIG. 10 is a perspective view showing the positional relation between the positioning hole and the positioning pin according to the second embodiment of this invention; and FIG. 11 is a view showing a state where the positioning pin is inserted into the positioning hole according to the second embodiment of this invention.

A positioning hole 64 is first described. The bottom wall 92 serving as the first member, comprising the bottom surface 20 of the printer housing 11 (FIG. 5) has the thickness T, in which an up-right portion 95 is formed as projecting upward to the bottom wall 92. Furthermore, the positioning hole 64 having a cross-sectional surface in a circular shape and the inner diameter D is formed to the bottom wall 92 as well as the up-right portion 95. The up-right portion 95 is formed within a prescribed range in a circumferential direction, along with the positioning hole 64, on the non moving-up side on a margin of the inner circumference of the positioning hole 64. Furthermore, the positioning pin 56 having the diameter d and the height h is formed to the upper wall 93 serving as the second member, configuring the upper surface 25 of the additionally installable tray 50.

On the up-right portion 95, a chamfering process is made to a portion in contact with the upper end portion near the ridgeline of the most non moving-up side on the inner circumferential surface of the positioning hole 64 to prevent the positioning hole 64 and the positioning pin 56 from interfering with each other at a time that the printer housing 11 is lifted up at the tilt angle α between the bottom surface 20 and the upper surface 25. A portion where the chamfering process is made, i.e., a chamfering processed portion is rendered to have height a, width h, and a chamfering angle equal to the tilt angle α. Furthermore, on a side where the chamfering process is not made, i.e., on the moving-up side of the up-right portion 95, a portion above the bottom wall 92 is cut out.

Figure 11:
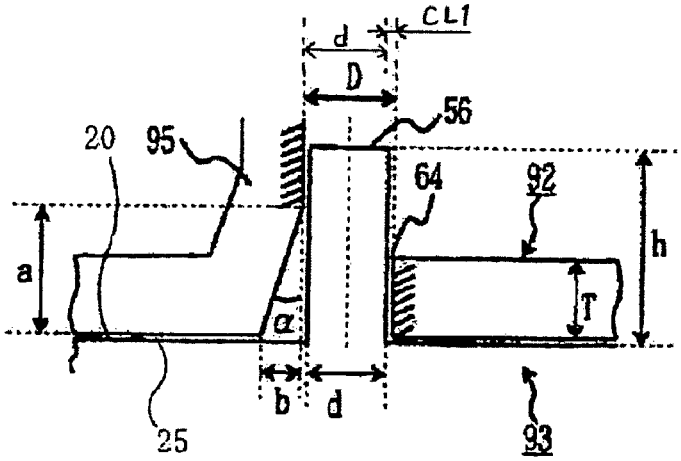
FIG. 11 is a view showing a state where the positioning pin is inserted into the positioning hole according to the second embodiment of this invention.

Therefore, when the positioning pin 56 is inserted into the positioning hole 64, as shown in FIG. 11, the upper surface 20 comes in contact with the bottom surface 25, and the positioning pin 56 is fastened to the up-right portion 95 with a portion corresponding to distance (h−a) on the up-right portion 95, i.e., a first fastening portion on the non moving-up side while fastened to the bottom wall 92 with a portion corresponding to the thickness T of the bottom wall 92, i.e., a second fastening portion on the moving-up side. It is to be noted that on the moving-up side, the up-right portion 95 above the bottom wall 92 is cut out, and the positioning pin 56 projects from the bottom wall 92, so that the projecting portion corresponding to distance (h−T) is formed. That is, on the moving-up side, the positioning pin 56 becomes the free state with respect to the positioning hole 64, thereby not fastened to the bottom wall 92.

Where the operator installs the additionally installable tray 50 to the printer housing 11, as shown in FIG. 11, the positioning pin 56 is fastened to the up-right portion 95 with the first fastening portion on the non moving-up side while fastened to the bottom wall 92 with the second fastening portion on the moving-up side. In this situation, the positioning pin 56 needs to be inserted precisely into the positioning hole 64 on the moving-up side, so that the clearance CL1 of the inner diameter D of the positioning hole 64 with respect to the outer diameter d of the positioning pin 56, which is determined by the formula, CL1=D−d, is set to not less than 0.1 [mm] nor more than 0.2 [mm].

It is to be noted that unless the height h of the positing pin 56 is not less than the height a of the chamfering processed portion, the position can not be precisely set.

Where those conditions are satisfied, the positioning pin 56 is to be precisely inserted into the positioning hole 64.

A positional relation between the positioning hole 64 and the positioning pin 56 at a time that the additionally installable tray 50 is detached is described next.

Figure 12:
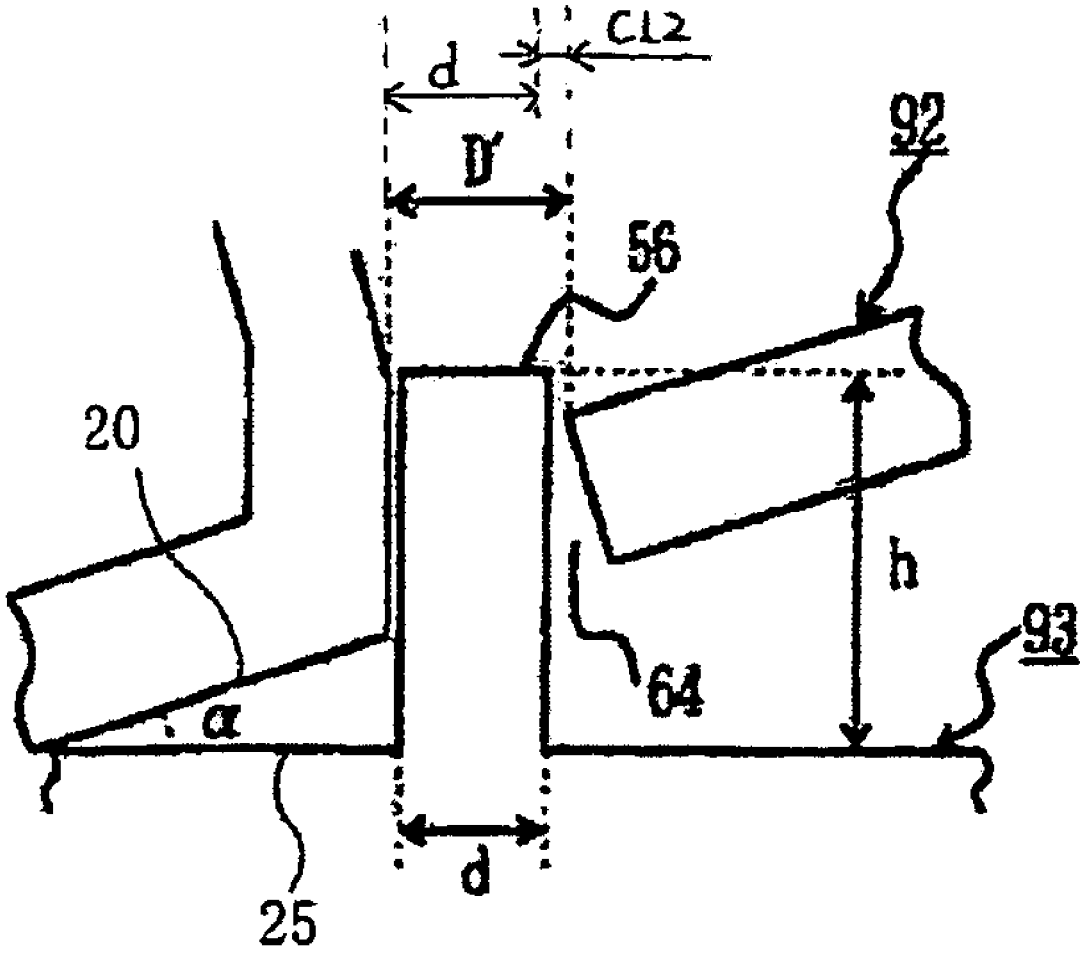
FIG. 12 is a view showing the positional relation between the positioning pin and the positioning hole at a time that the additionally installable tray is detached according to the second embodiment of this invention.

FIG. 12 is a view showing the positional relation between the positioning pin and the positioning hole at a time that the additionally installable tray is detached according to the second embodiment of this invention.

Where the additionally installable tray 50 is detached upon tilting the printer housing 11 (FIG. 5) at the tilt angle α, the positioning pin 56 is rendered close to the chamfering processed portion as shown in FIG. 12, so that the apparent inner diameter of the positioning hole 64 changes. In this bout, inner diameter D' of the positioning hole 64 at a time that the printer housing 11 is tilted needs to be larger than the original inner diameter D (FIG. 11) so that the positioning pin 56 does not get caught in the positioning hole 64. It is to be noted that when the detachment operation is considered, clearance CL2 of the inner diameter D' of the positioning hole 64 with respect to the outer diameter d of the positioning pin 56, which is determined by formula, CL2=D'−d, is set to not less than 1.0 [mm] nor more than 2.0 [mm].

Furthermore, relation between the inner diameter D' and the inter diameter D is set as formula, $D'=D\cdot\cos\alpha+(a-T)\sin\alpha$.

It is to be noted the clearance CL2 changes in accordance with change of the tilt angle α.

As described above, in this embodiment, since the chamfering process is made to the positioning hole 64, the clearance CL2 of the fitting portion between the positioning hole 64 and the positioning pin 56 becomes larger in accordance of a tilt of the printer housing 11, so that the additionally installable tray 50 can be detached from the printer housing 11 without deforming the positioning pin 56.

Furthermore, since the positioning hole 64 does not get caught by the positioning pin 56, it does not happen that the additionally installable tray 50 is lifted up in accordance with a lift of the printer housing 11 and falls down in the middle, so that the additionally installable tray 50 does not get damaged.

The third embodiment is next described. It is to be noted that that members structured the same as in the first embodiment and the second embodiment are assigned with the same numerals to omit the duplicated explanation, and the advantages of this invention are applicable to the third embodiment because of the same structure as the first embodiment and the second embodiment.

Figure 13:
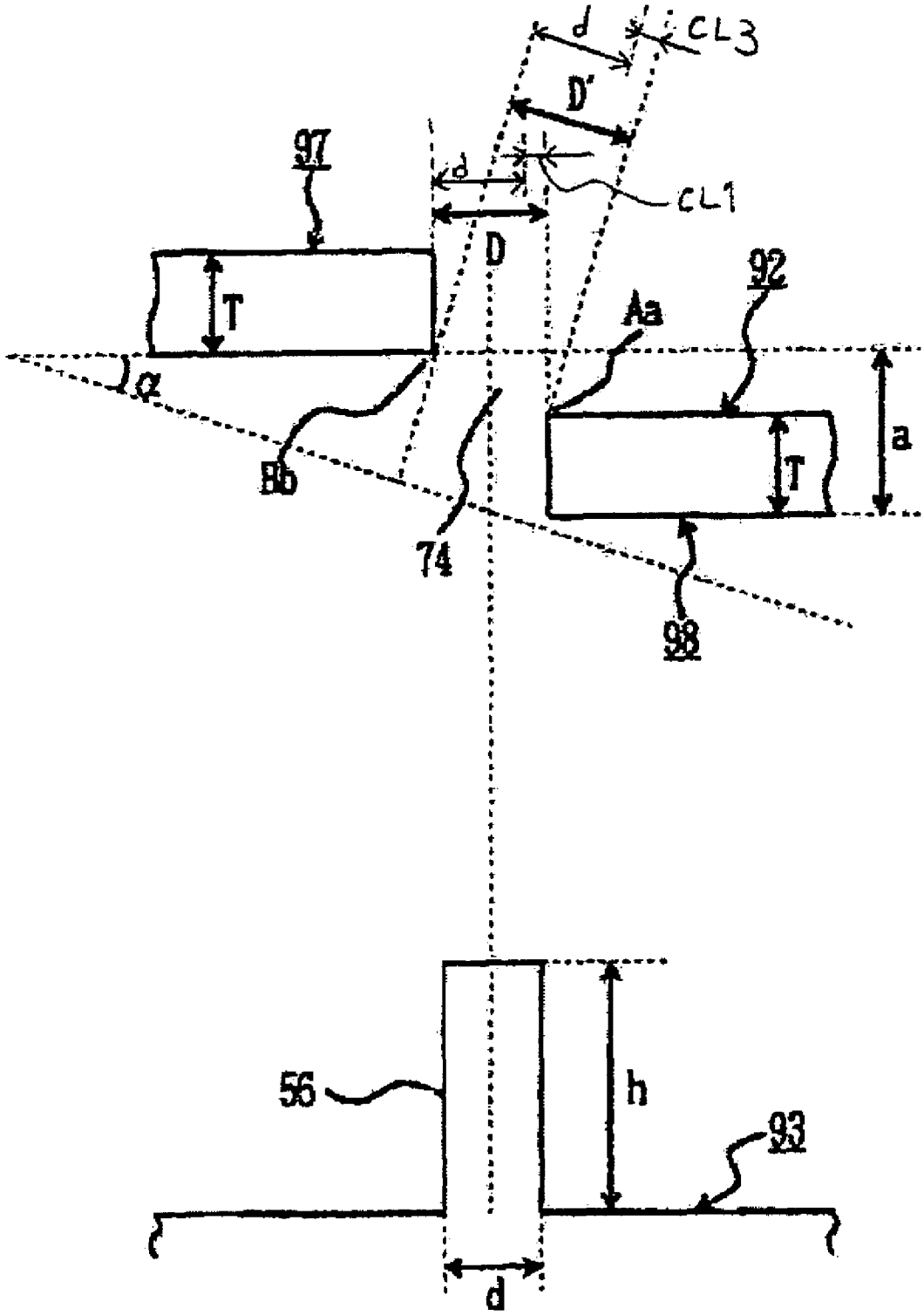
FIG. 13 is a cross-sectional view showing a positional relation between a positioning hole and a positioning pin according to the third embodiment of this invention.
Figure 14:
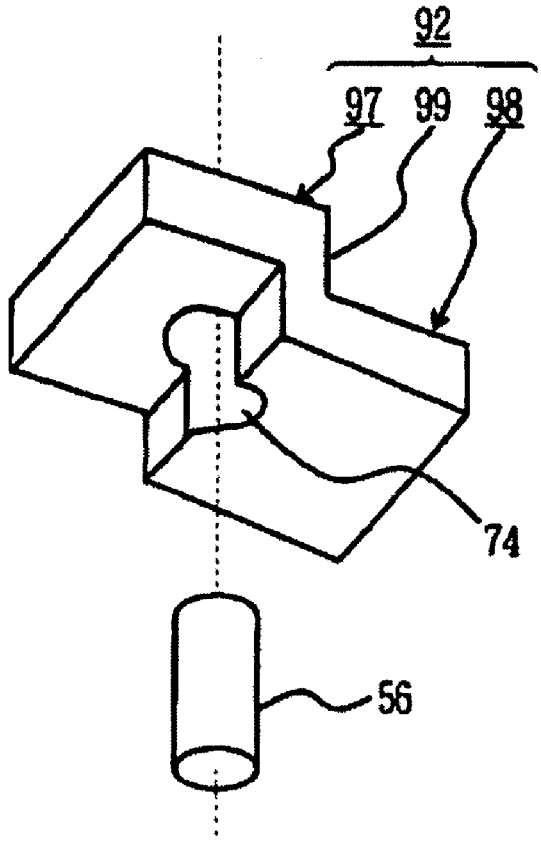
FIG. 14 is a perspective view showing the positional relation between the positioning hole and the positioning pin according to the third embodiment of this invention.

FIG. 13 is a cross-sectional view showing a positional relation between a positioning hole and a positioning pin according to the third embodiment of this invention; FIG. 14 is a perspective view showing the positional relation between the positioning hole and the positioning pin according to the third embodiment of this invention; and FIG. 15 is a view showing a state where the positioning pin is inserted into the positioning hole according to the third embodiment of this invention.

A positioning hole 74 is first described. The bottom wall 92 serving as the first member, configuring the bottom surface of the printer housing 11 (FIG. 5) has the thickness T, and composed of an upper side wall portion 97 formed on the non moving-up side and a lower side wall portion 98 formed on the moving-up side, in which the upper side wall portion 97 has a first bottom surface 30 while the lower side wall portion 98 has a second bottom surface 35, in which a different level of height α is formed between the first bottom surface 30 and the second bottom surface 35, in which a positioning hole 74 having a cross-sectional surface in a circular shape and the diameter D is formed on a portion where the different level is formed. Furthermore, the positioning pin 56 having the diameter d and the height h is formed to on the upper wall 93 serving as the second member, configuring the upper surface of the additionally installable tray 50.

With respect to the positioning hole 74, a portion below the upper side wall portion 97 on the non moving-up side as well as a portion above the down side wall portion 98 on the moving-up side are both rendered unfastened.

Figure 15:
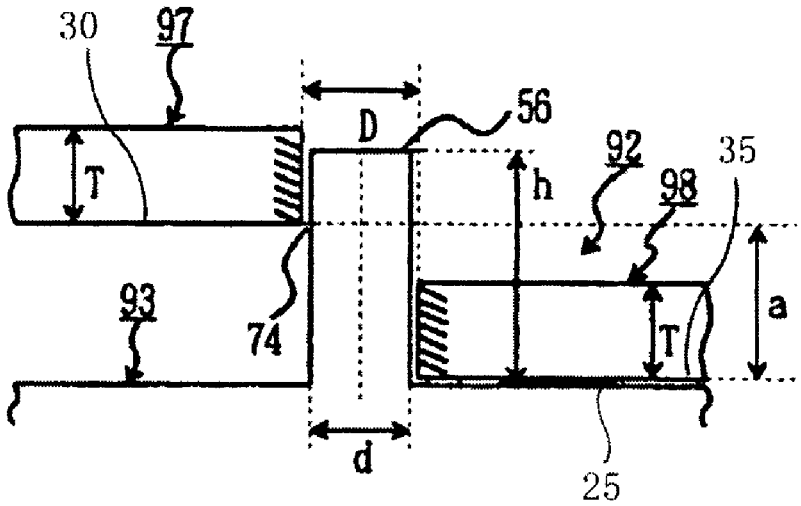
FIG. 15 is a view showing a state where the positioning pin is inserted into the positioning hole according to the third embodiment of this invention.

Therefore, when the positioning pin 56 is inserted into the positioning hole 74, as shown in FIG. 15, the second upper surface 25 comes in contact with the bottom surface 20, and the positioning pin 56 is fastened to the upper side wall portion 97 with a portion corresponding to the distance (h−a) on the bottom wall 92, i.e., the first fastening portion on the non moving-up side while fastened to the lower side wall portion 98 with a portion corresponding to the thickness T of the bottom wall 92, i.e., the second fastening portion on the moving-up side. It is to be noted that on the moving-up side, the positioning pin 56 projects from the lower side wall portion 98, so that the projecting portion corresponding to the distance (h−T) is formed. That is, on the moving-up side, the positioning pin 56 becomes the free state with respect to the positioning hole 74, thereby not fastened to the bottom wall 92. Furthermore, an up-right portion 99 is formed between the upper side wall portion 97 and the lower side wall portion 98.

It is to be noted that a distance between point Aa on the upper end of the ridgeline on the most moving-up side on the inner circumferential surface of the positioning hole 74 and point Bb on the lower end of the ridgeline on the most non moving-up side on the inner circumferential surface of the positioning hole 74 is set to D'.

Where the operator installs the additionally installable tray 50 to the printer housing 11, the positioning pin 56 is fastened to the upper side wall portion 97 with the first fastening portion on the non moving-up side while fastened to the lower side wall portion 98 with the second fastening portion on the moving-up side. In this bout, the positioning pin 56 needs to be inserted precisely into the positioning hole 74, so that the clearance CL1 of the inner diameter D of the positioning hole 74 with respect to the outer diameter d of the positioning pin 56, which is determined by the formula, CL1=D−d, is set to not less than 0.1 [mm] nor more than 0.2 [mm].

It is to be noted that unless the height h of the positing pin 56 is not less than the height a of the chamfering processed portion, the position can not be precisely set.

Where those conditions are satisfied, the positioning pin 56 is to be precisely inserted into the positioning hole 74.

A positional relation between the positioning hole 74 and the positioning pin 56 at a time that the additionally installable tray 50 is detached is described next.

Figure 16:
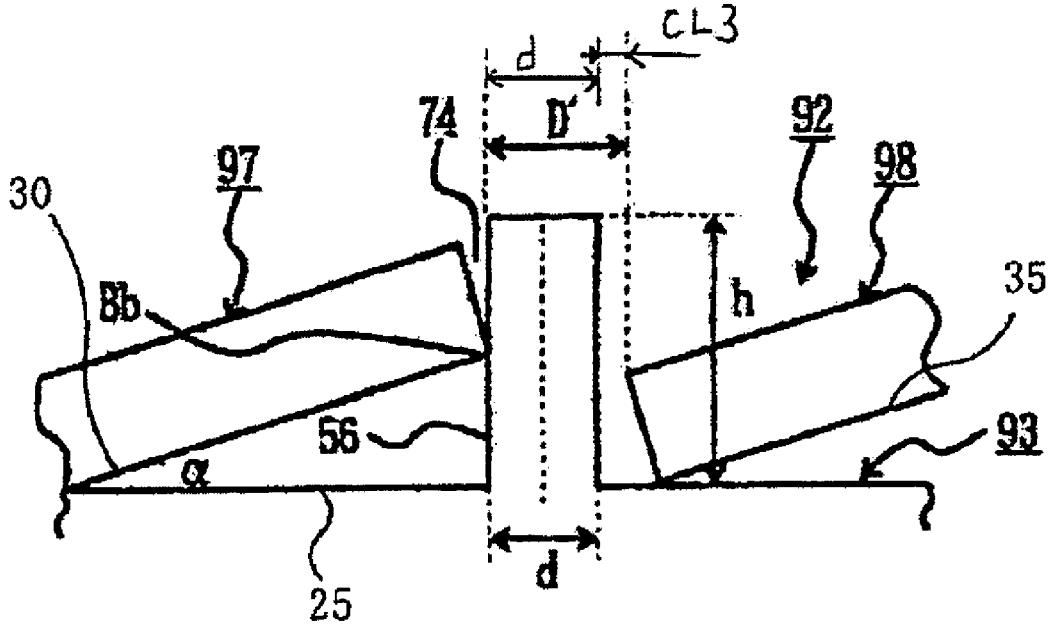
FIG. 16 is a view showing the positional relation between the positioning pin and the positioning hole at a time that the additionally installable tray is detached according to the third embodiment of this invention.

FIG. 16 is a view showing the positional relation between the positioning pin and the positioning hole at a time that the additionally installable tray is detached according to the third embodiment of this invention.

Where the additionally installable tray 50 is detached upon tilting the printer housing 11 at the tilt angle α, the positioning pin 56 is rendered close to the point Bb, so that the apparent inner diameter of the positioning hole 74 changes into the distance D'. In this bout, inner diameter D' of the positioning hole 74 at a time that the printer housing 11 is tilted needs to be larger than the original inner diameter D so that the positioning pin 56 does not get caught in the positioning hole 74. It is to be noted that when the detachment operation is considered, clearance CL3 of the inner diameter D' of the positioning hole 74 with respect to the outer diameter d of the positioning pin 56, which is determined by formula, CL3=D'−d, is set to not less than 1.0 [mm] nor more than 2.0 [mm].

Furthermore, relation between the inner diameter D' and the inter diameter D is set to formula, $D'=D\cdot\cos\alpha+(a-T)\sin\alpha$.

It is to be noted the clearance CL3 changes in accordance with change of the tilt angle α.

As described above, in this embodiment, since the different level is formed to the positioning hole 74, the clearance CL3 of the fitting portion between the positioning hole 74 and the positioning pin 56 becomes larger in accordance of a tilt of the printer housing 11, so that the additionally installable tray 50 can be detached from the printer housing 11 without deforming the positioning pin 56.

Furthermore, since the positioning hole 74 does not get caught by the positioning pin 56, it does not happen that the additionally installable tray 50 is lifted up in accordance with a lift of the printer housing 11 and falls down in the middle, so that the additionally installable tray 50 does not get damaged.

It is to be noted that this invention is not limited to these above described embodiments but can be variously modified based on the purpose of this invention, and these modifications are not excluded from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A composite apparatus comprising a first apparatus in connection with a second apparatus, comprising:

a first surface formed on said first apparatus, facing said second apparatus, a second surface formed on said second apparatus, facing said first apparatus, a projecting portion formed on said second apparatus, projecting from said second surface;

a hole portion formed on said first apparatus, to be inserted with said projecting portion;

a first positioning portion formed near said hole portion, for positioning said projecting portion in a state where said first apparatus is in contact with said second apparatus; and a second positioning portion formed near said hole portion, for positioning said projecting portion in a state where said first apparatus is in contact with said second apparatus, wherein:

said first and second positioning portions are different in a distance from said first surface;

a first space is defined by a space opposite to the first positioning portion across the projecting portion and opposite to the first surface with respect to the second surface, the first space being capable of accommodating the projecting portion;

when the first and second apparatuses are attached and the first surface comes to a prescribed position, the projecting portion moves toward the first positioning portion;

when the first apparatus tilts with respect to the second apparatus and the first surface tilts with respect to the prescribed position, the projecting portion moves away from the first positioning portion;

a second space is defined by a space opposite to the second positioning portion across the projecting portion at a side of the first surface with respect to the first positioning portion, the second space being capable of accommodating the projecting portion;

when the first and second apparatuses are attached and the first surface comes to the prescribed position, the projecting portion moves toward the second positioning portion;

when the first apparatus tilts with respect to the second apparatus and the first surface tilts with respect to the prescribed position, the projecting portion moves away from the second positioning portion;

where the first and second apparatuses are attached, the hole portion has a first clearance between a diameter of the projecting portion and a space between the first and second positioning portions;

where the first apparatus is tilted with respect to the second apparatus while the projecting portion is located between the first and second positioning portions, the hole portion has a second clearance between the diameter of the projecting portion and the space between the first and second positioning portions;

the second clearance is larger than the first clearance;

a distance from the first surface to the first positioning portion is larger than a thickness of the second positioning portion;

a height of the projecting portion is larger than the distance from the first surface to the first positioning portion; and the height of the projecting portion is smaller than a summation of the thickness of the first positioning portion and the distance from the first surface to the first positioning portion.

2. The composite apparatus according to claim 1, wherein:

the first apparatus is arranged on or above the second apparatus;

the first and second positioning portions are arranged at a lower side of the first apparatus;

the projecting portion is arranged at an upper side of the second apparatus;

the first surface is arranged at the lower side of the first apparatus and is arranged in close proximity of the first and second positioning portions; and the second surface can be in contact with the first surface, the second surface being at the upper side of the second apparatus, the second surface being in close proximity of the projecting portion.

* * * * *